US009592944B2

(12) United States Patent
Johnson

(10) Patent No.: US 9,592,944 B2
(45) Date of Patent: Mar. 14, 2017

(54) ASEPTIC DUCKBILL FLIP-CAP FITMENT FOR A COLLAPSIBLE CONTAINER

(75) Inventor: James Johnson, Delaware, OH (US)

(73) Assignee: LIQUI-BOX CORPORATION, Richmond, VA (US)

( * ) Notice: Subject to any disclaimer, the term of this patent is extended or adjusted under 35 U.S.C. 154(b) by 724 days.

(21) Appl. No.: 13/597,401

(22) Filed: Aug. 29, 2012

(65) Prior Publication Data

US 2013/0047557 A1 Feb. 28, 2013

Related U.S. Application Data

(60) Provisional application No. 61/528,508, filed on Aug. 29, 2011.

(51) Int. Cl.
*B67D 1/00* (2006.01)
*B65D 75/58* (2006.01)

(52) U.S. Cl.
CPC ..... *B65D 75/5872* (2013.01)

(58) Field of Classification Search
CPC ..... B65D 47/2031; B65D 51/002; B65D 75/5877; B65D 47/2018; B65D 47/2037; B65D 47/38; B65D 75/5872; B67D 7/06
USPC ..... 141/329, 330; 215/247, 297, 354; 222/80, 81, 83, 83.5, 89, 90, 105, 222/490–494, 544, 546, 562, 563; 383/80, 96, 202
IPC ..... B65D 47/2031,51/002, 75/5877, 47/2018, 47/2037, 47/38, 75/5872
See application file for complete search history.

(56) References Cited

U.S. PATENT DOCUMENTS

| | | | | |
|---|---|---|---|---|
| 4,436,125 | A | 3/1984 | Blenkush | |
| 5,010,925 | A | 4/1991 | Atkinson et al. | |
| 2004/0178220 | A1* | 9/2004 | Smith | 222/83 |
| 2007/0131725 | A1 | 6/2007 | Friedman | |
| 2007/0205216 | A1* | 9/2007 | Smith | 222/81 |
| 2008/0029540 | A1* | 2/2008 | Johnson | 222/83 |
| 2009/0120899 | A1 | 5/2009 | Stull, Sr. et al. | |
| 2010/0133273 | A1* | 6/2010 | Thurman et al. | 220/260 |
| 2010/0176152 | A1* | 7/2010 | Johnson | 222/92 |

FOREIGN PATENT DOCUMENTS

| | | |
|---|---|---|
| JP | 01137873 | 9/1989 |
| JP | 2002/160730 | 6/2002 |
| WO | WO 2005/012129 | 2/2005 |
| WO | WO 2008/025146 | 3/2008 |
| WO | WO 2010/066926 | 6/2010 |
| WO | WO 2010/080897 | 7/2010 |

OTHER PUBLICATIONS

U.S. Appl. No. 61/528,508, Specification filed Aug. 29, 2011.
International Search Report and Written Opinion for PCT/US2012/052754 dated Feb. 19, 2013.

* cited by examiner

*Primary Examiner* — Patrick M Buechner
(74) *Attorney, Agent, or Firm* — Baker & Hostetler LLP

(57) ABSTRACT

A fitment for use with a collapsible bag for dispensing liquids or semi-solids having a spout of a generally cylindrical body attached to a collapsible bag, an aseptic flip-cap attached to the spout having positioned therein a flexible cap duckbill that allows for the flow of fluid when engaged with a probe assembly, wherein the flip-cap forms an aseptic seal with the spout on the collapsible bag.

13 Claims, 8 Drawing Sheets

FLIP LID
EXPLODED ASSEMBLY

ASEPTIC DUCKBILL FLIP-CAP FITMENT FOR A COLLAPSIBLE CONTAINER

CROSS REFERENCE TO RELATED APPLICATION

This application claims the benefit of U.S. Provisional Application No. 61/528,508 filed Aug. 29, 2011, which is hereby incorporated by reference.

FIELD OF THE INVENTION

The present disclosure relates to a fitment and its use with a collapsible container for dispensing liquids or semi-solids from said container. More particularly, the present disclosure relates to a fitment comprising a duckbill flip-cap for use on a collapsible container to dispense liquids and semi-solids from the container, wherein said duckbill flip-cap fitment forms an aseptic seal with the spout on said collapsible container.

BACKGROUND

Many systems dispense liquids or semi-solids from a disposable package consisting of a flexible collapsible bag in a corrugated box. Such a package is commonly referred to as a bag-in-box dispensing package. Generally, these systems include a bag that is provided with a fitment in the form of a spout through which filling and dispensing occur. It is generally desirable to provide a quick-disconnect coupling between the spout and the service line of the pump or other type of beverage mixing and dispensing system.

However, these closures often employ complicated sealing structures to provide an adequate seal to prevent a product spill. In the past, elastomeric check-valves and O-ring seals have been employed. Furthermore, because the assembly requires multiple parts, it renders these closure valves non-cost-effective.

Typically, these fluid couplings use connections such as an insert, and/or cap, connected with a fluid source, such as a bag or bag-in-box. The insert is coupled with a connector or coupler body that can access a fluid dispensing system such as a fluid line. Many connectors employ a piercing member at one end to puncture a membrane seal disposed on the insert when the connector is mated with the insert for fluid dispensing. Further, such connectors used to mate with the insert on the fluid source are produced so as to be reusable.

In addition, the industry needs coupling valve assemblies that can be reused with various connections. The present invention addresses this need and provides a non-disposable coupling-valve assembly that can be utilized with various fluid conduit adaptors.

Commercial and industrial applications routinely employ disposable containers to transport and dispense a variety of liquids or fluids such as food products, cleaning solutions and detergents. Some containers are constructed of semi-rigid plastic while others are constructed of flexible plastic and are often supported within a protective box.

Commonly, such containers are equipped with valve structures that facilitate dispensing fluids to or from the containers. The valve structures are preferably designed to quickly couple with exterior coupling members.

The female coupling includes a releasable locking or quick-connecting/disconnecting mechanism for locking the male and female couplings together in a coupled state. U.S. Pat. No. 4,436,125 discloses a quick-connect/disconnect coupling assembly. A female coupling member includes a poppet valve assembly that automatically shuts off the fluid passageway in the female coupling member when the female coupling member is not interconnected to the male coupling member.

SUMMARY OF THE INVENTION

One aspect of the present invention is fitment for use on a collapsible bag for dispensing of liquids and semi-solids from the bag, the fitment comprising:

(a) a spout comprising a generally hollow cylindrical body having an external surface capable of mating with an aseptic flip-cap, the spout having at one end, a base portion for securing the spout to the collapsible bag;

(b) an aseptic flip-cap having an outer collar and an inner collar with the outer collar and the inner collar each having an inner and outer surface, the inner surface of the outer collar and the outer surface of the inner collar forming a cavity adapted to be removably attachable to the spout, the inner surface of the inner collar being capable of attaching to a cap duckbill, the aseptic flip-cap further comprising a hollow cylinder section comprising a proximal end and a distal end with each having an inner and outer surface, the cylinder section being fixedly attached at its distal end to the inner collar, the inner surface of the inner collar and the outer surface of the proximal end of the cylinder forming a cavity, the aseptic flip-cap optionally comprising a flange fixedly attached to the outer surface of the outer collar;

wherein the outer surface of said inner collar comprises at least one sealing ring;

(c) a slidably removable probe; and (d) a substantially hollow cap duckbill adapted to mate with the proximal end of the aseptic flip-cap and which forms a seal within the fitment that can be unsealed by insertion of the probe into the fitment through the hollow cylinder of the aseptic flip-cap, the cap duckbill having a tapered end and an ejection end, the tapered end having a reversibly sealable slit capable of preventing fluid flow through the aseptic flip-cap upon removal of the probe from the fitment.

This invention also relates to a process for filling an unfilled collapsible bag for dispensing of liquids and semi-solids from said collapsible bag, comprising a fitment as recited above, comprising:

(a) introducing said unfilled collapsible bag into a filling chamber under aseptic conditions;

(b) dismounting said fitment from said spout on said unfilled collapsible bag under aseptic conditions;

(c) filling said unfilled collapsible bag with material for dispensation;

(d) re-mounting said fitment on said spout; and (e) closing the aseptic flip-cap.

Other objects and advantages will become apparent to those skilled in the art upon reference to the detailed description that hereinafter follows.

DETAILED DESCRIPTION OF THE INVENTION

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

DEFINITIONS

In the context of this disclosure, a number of terms shall be utilized.

As used herein, the term "about" or "approximately" means within 20%, preferably within 10%, and more preferably within 5% of a given value or range.

The term "comprising" is intended to include embodiments encompassed by the terms "consisting essentially of" and "consisting of". Similarly, the term "consisting essentially of" is intended to include embodiments encompassed by the term "consisting of."

Fitment

The aseptic fitment of the present invention is attached to a liquid container, which usually is a flexible bag of a plastic material or a semi-rigid container, also of a plastic material, that holds liquids or semi-solids that are to be dispensed. The fitment can be tailored to the size of the bag or container so that a desired level of flow can be achieved. A wide variety of liquids or semi-solids can be dispensed using the fitment, such as liquid foods, for example, coffee, soda, milk, cooking oil, or liquid chemicals of various types, such as, detergents, cleaning liquids, hand soap, pastes, glue.

Figure 1:
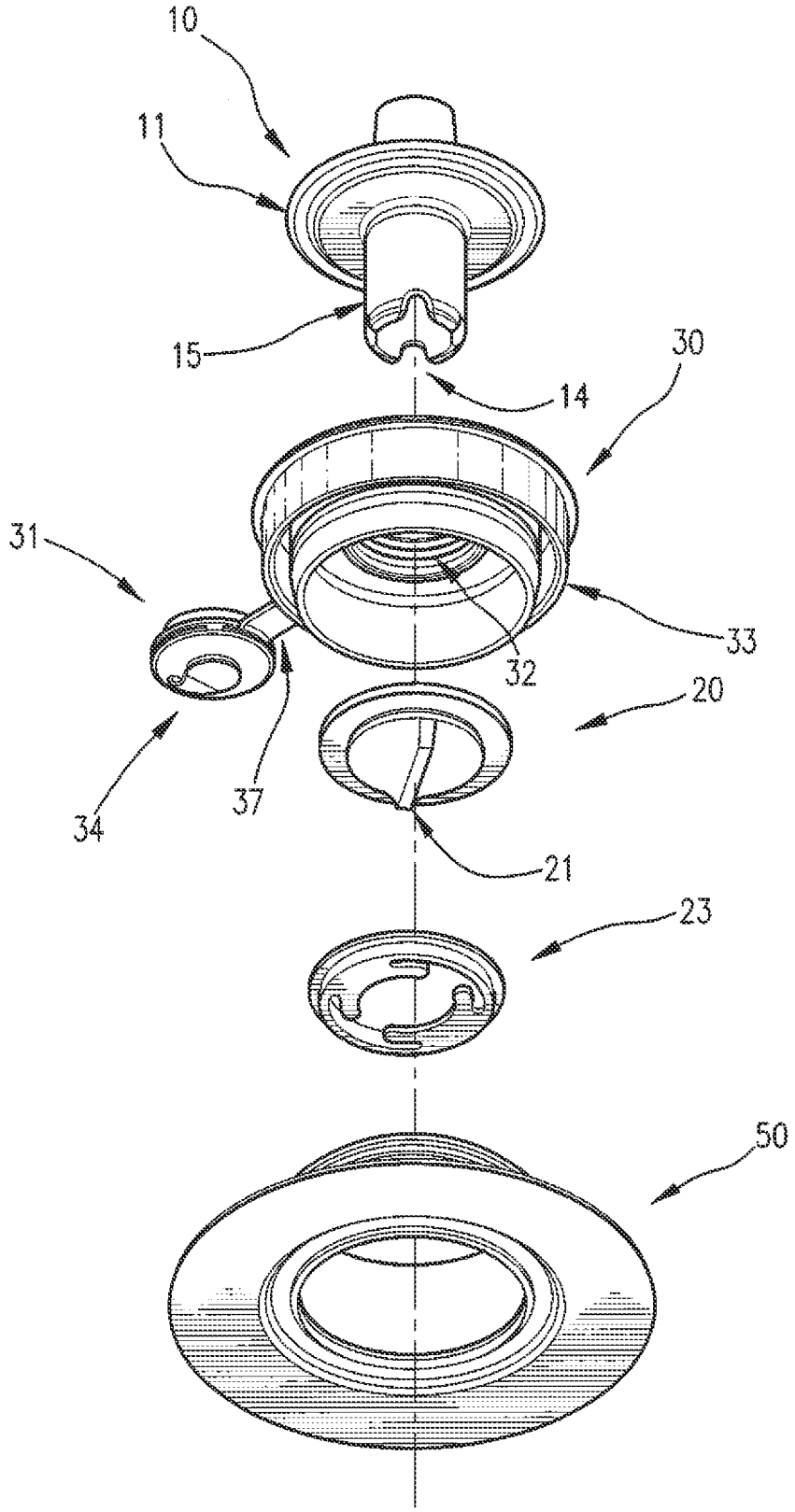
FIG. 1 is a bottom view of an exploded assembly of the fitment.

FIG. 1 shows an exploded bottom view of the fitment assembly of this invention. A probe 10 is fitted into an aseptic flip-cap 30 having a flip lid 31 with a pull tab 34. Cap duckbill 20 is positioned in the bottom of the aseptic flip-cap 30. A duckbill lock ring 23 is positioned between the cap duckbill 20 and the spout 50. Upon engagement of the cap duckbill 20 with the duckbill lock ring 23 and the spout 50, the duckbill lock ring 23 locks into aseptic flip-cap and holds the duckbill product flow opening 21 in the cap duckbill 20, closed, and prevents seepage or leakage of liquid that is to be dispensed from the bag or container (not shown) to which spout 50 is attached. Extended periods of holding the liquid container at cold temperatures can cause distortion of the cap duckbill 20 thereby allowing liquid to seep through the flow opening 21. The use of the duckbill locking ring 23 generally prevents such seepage. The present invention, however, provides an additional mechanism to seal the collapsible container (not shown), that is, providing an aseptic flip-cap 30 that engages the spout 50 in such fashion that the seal between the fitment and the spout 50 is aseptic.

Probe 10 through which material from the bag or container is dispensed, typically is a molded thermoplastic material usually a polyolefin, such as, polyethylene, copolymers and terpolymers of polyethylene, polypropylene, copolymers and terpolymers of polypropylene, polybutylene and copolymers and terpolymers thereof, fluorocarbon polymers and copolymers thereof, polyvinyl chloride and copolymers thereof, polyvinylidene chloride and fluorocarbon polymers and copolymers thereof. Thermosetting polymers such as epoxy resins, phenolic resins, melamine resins can also be used for dispersing some substances. Preferably, polyethylene, polypropylene and copolymers and terpolymers thereof are used for most applications.

Figure 2:
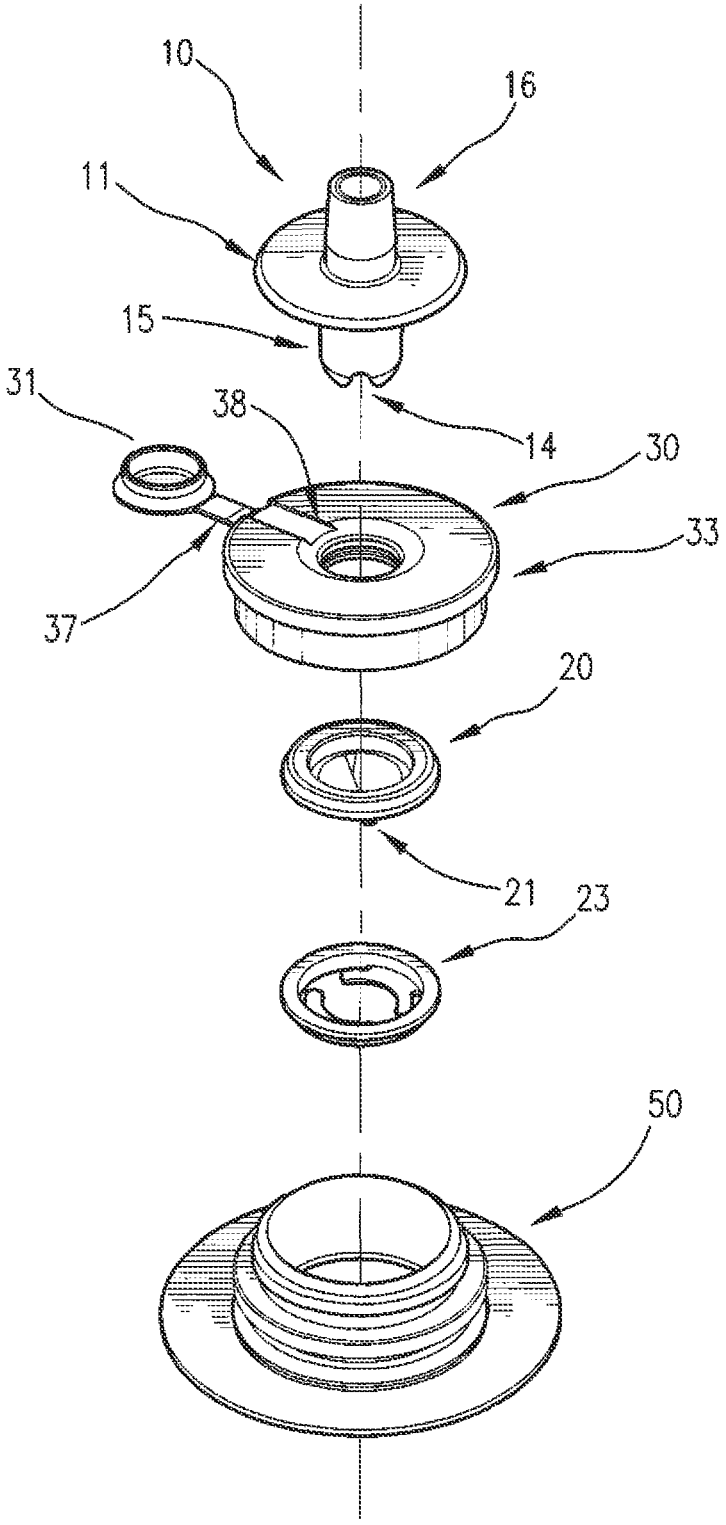
FIG. 2 is a top view of an exploded assembly of the fitment.

FIG. 2 shows a top view of an exploded assembly of the fitment of this invention. Probe 10 is fitted into the inner circular opening 32 of aseptic flip-cap 30 having flip lid 31 attached thereto by hinge 37. Hinge 37 fits into the recessed area 38 of cap 30 allowing flip lid 31 to recess into the inner circular opening 32 of aseptic flip-cap 30 (shown in FIG. 1) thereby providing a level and even surface to the top of aseptic flip-cap 30 when flip lid 31 is in a closed position. Duckbill lock ring 23 is positioned between cap duckbill 20 and the top of spout 50 and locks into cap 30.

Figure 3:
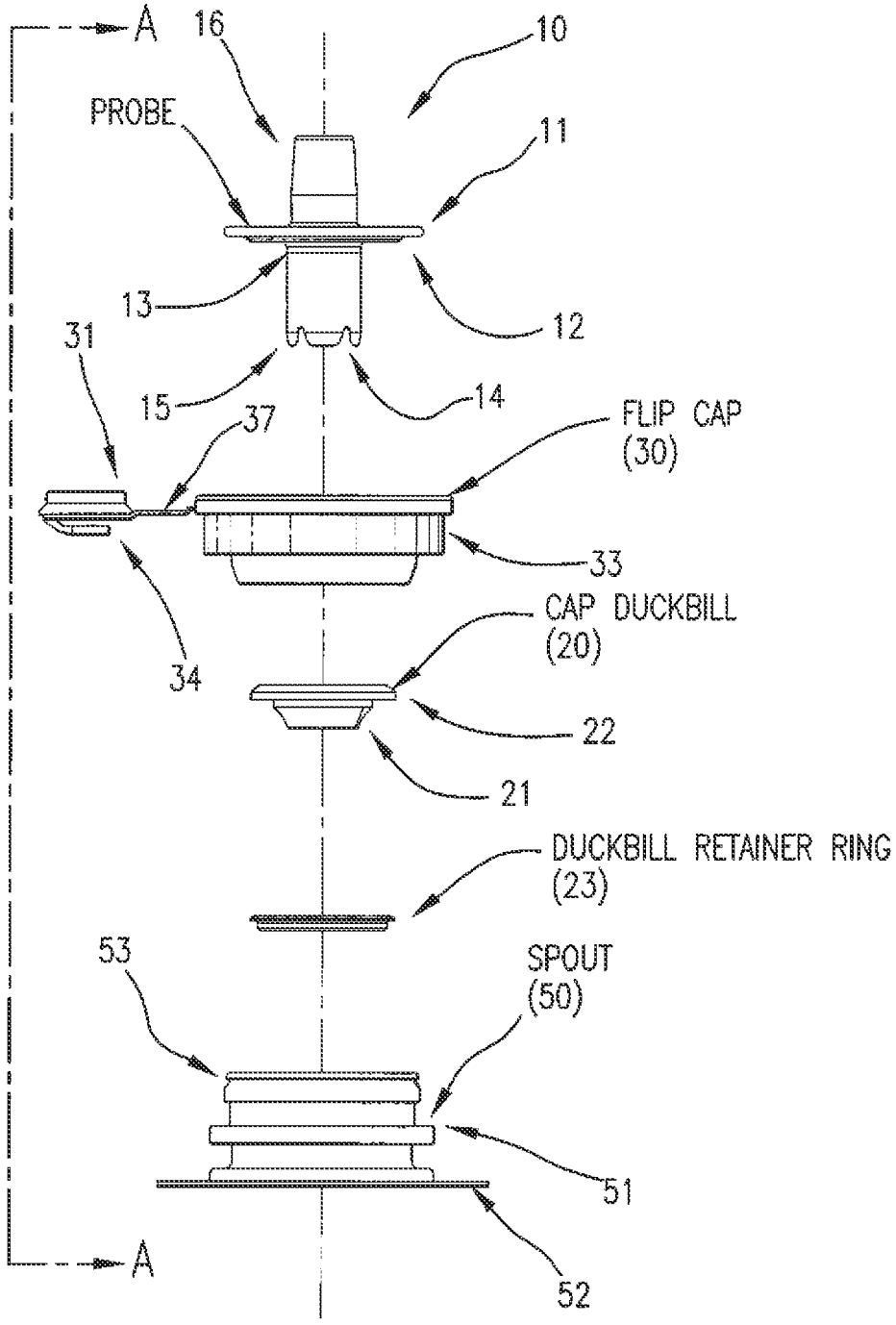
FIG. 3 is a side view of an exploded assembly of the fitment.

FIG. 3 shows a side view of an exploded assembly of the fitment of FIG. 1. The probe 10, which typically is a molded plastic part, has a nozzle 16 and a flange 11 molded to the nozzle 16 that presses against the aseptic flip-cap 30. The flange 11 is reinforced with a flange-strengthening rib 12. A locking bead 13 is molded to flange strengthening rib 12 of the probe 10. The locking bead 13 of the probe to is attached to the aseptic flip-cap 30 and forms a seal with the aseptic flip-cap 30. Probe lead-in 15, preferably having at least two more, and preferably four, product flow slots 14 through which product flows from bag, engages and forms a seal with the inner circular opening 32 of the aseptic flip-cap 30. (Also see FIG. 1 and FIG. 2). The probe lead-in 15 need not have these product flow slots 14 and still be operative and allow for flow of fluid from the bag or container.

In one embodiment, the total length of the probe 10 is about 1 to 2 inches, typically 1.4 inches, and the nozzle 16 of the probe 10 is about 0.75 inches. In another embodiment, the outer diameter of the nozzle 16 of the probe is about 0.5 inches. In yet another embodiment, the diameter of the flange 11 that presses against the aseptic flip-cap 30 depends on the width of the cap but typically is about 1.325 inches. In another embodiment, typically, the thickness of the wall of the probe 10 is about 0.095 inch in the nozzle section and about 0.05 inch at the seal at the edge of the flange 11. The above dimensions can vary depending on the liquid being dispensed.

In one embodiment, the inner diameter of the nozzle 16 of the probe 10 is about 0.25 inch and a variety of hoses typically can be attached to the nozzle 16. Typically, the hoses are attached to the nozzle 16 by a friction fit of the hose to the nozzle; however, other methods also can be used, such as, a hose clamp or the exterior of the nozzle may be provided with ribs or with a roughened surface for a better friction fit.

In one embodiment, the cap duckbill 20 is a molded elastomeric product or a soft flexible plastic material having a duckbill product flow opening 21. (See FIG. 1 also.) The duckbill seal 22 is fitted into the bottom of the probe 10 and engages with the inner wall of the nozzle 16. The duckbill product flow opening 21 (illustrated in FIG. 1 in a closed position) of the cap duckbill 20 typically is a re-closable opening, such as a slit in the cap duckbill 20 that allows fluid to flow from the bag or container upon engagement of the probe 10 by application of a downward force applied to the duckbill 20. As pointed out above, the duckbill lock ring 23 prevents seepage of liquid through the product flow opening 21 until there is engagement by the probe 10. The product flow opening 21 of the cap duckbill 20 can be molded in such a manner that it would be broken open on engagement of probe 10. In the alternative, the product flow opening 21 can be sealed with a thin layer of material that is broken on engagement of the probe 10, or the opening itself can be sealed but breakable on engagement of the probe 10 and then re-sealable when the probe is disengaged. The duckbill seal 22 fits into aseptic flip-cap 30 and forms a seal with inner circular opening 32 of the aseptic flip-cap 30. Optionally, the duckbill seal 22 can be permanently attached to the aseptic flip-cap 30 by welding or heat sealing it to the aseptic flip-cap 30.

The primary advantage of the use of the cap duckbill 20 is to prevent back flow from the bag or container through the aseptic flip-cap 30 when the probe 10 is not engaged and the hose attached to the probe 10 is removed. The cap duckbill shape as shown in FIG. 1 is preferred but other shapes can be used that would provide the same function. Typically, the length of the cap duckbill 20 is from about 0.375 to 1.000 inch and the width about 0.3 inch, but these dimensions may vary depending on the design of the fitment.

The cap duckbill 20 is molded from an elastomeric material or a soft flexible plastic material that can withstand the effects of the fluid being dispensed. Typically useful elastomers are styrene/butadiene copolymers, butyl rubbers, polysulfide rubbers, polyisoprene, ethylene-propylene terpolymers (EPDM rubber), silicone rubbers, polyurethane rubbers, and the like. A soft flexible plastic material can also be used such a linear low molecular weight polyethylene or copolymers and blends thereof. The duckbill lock ring 23 also can be molded from any of the above materials, preferably, a plastic material, such as high density polyethylene or high density polypropylene.

In one embodiment, the flip-cap 30 is a molded plastic part preferably formed of polyethylene but any of the aforementioned thermoplastics can be used. The aseptic flip-cap 30 has attached to it a flip lid 31 by hinge 37, which can be moved and engaged with the opening of the aseptic flip-cap 32 and forms a seal to retain liquid in the bag or container when the probe 10 is not inserted into or when it is removed from the opening of the aseptic flip-cap 32. Also, a seal 32.1 of a thin film of plastic, coated paper, metal foil and the like can be sealed over the opening 32 of the flip-cap to keep liquid product in the container or bag fresh and prevent spoilage. (See FIG. 4.) This seal can readily be removed, broken, or punctured at the time when product is to be removed from the container or bag. A pull tab 34 is molded to the flip lid 31 for easy opening and closing of the flip lid 31. The aseptic flip-cap 30 has a handling flange 33 for holding the aseptic flip cap 30 while it is being moved over the spout 50 or removed there-from. The interior of the aseptic flip-cap 30 fits over the sealing bead(s) 53 of the spout 50 to form a liquid tight seal with the spout 50. The spout 50 also has a sealing flange 52 molded thereto and forms a liquid tight seal with the bag or container (not shown) when attached thereto.

The flip lid 31 of the aseptic flip-cap 30 is an optional feature and can be eliminated in particular when a seal is positioned over the opening 32 of the cap 30 and when the fitment is used only for an initial installation and the bag or container is not subsequently removed or closed after disengagement of the probe 10.

Another optional feature is that the hinge 37 of the flip lid 31 can be recessed into a slot or recessed area 38 in the aseptic flip-cap 30 to form a even surface on the flip lid 30. The recessed area 38 in the aseptic flip-cap 30 is of a sufficient depth so that the flip lid 31 and the pull tab 34 are also recessed in the aseptic flip-cap 30.

Figure 4:
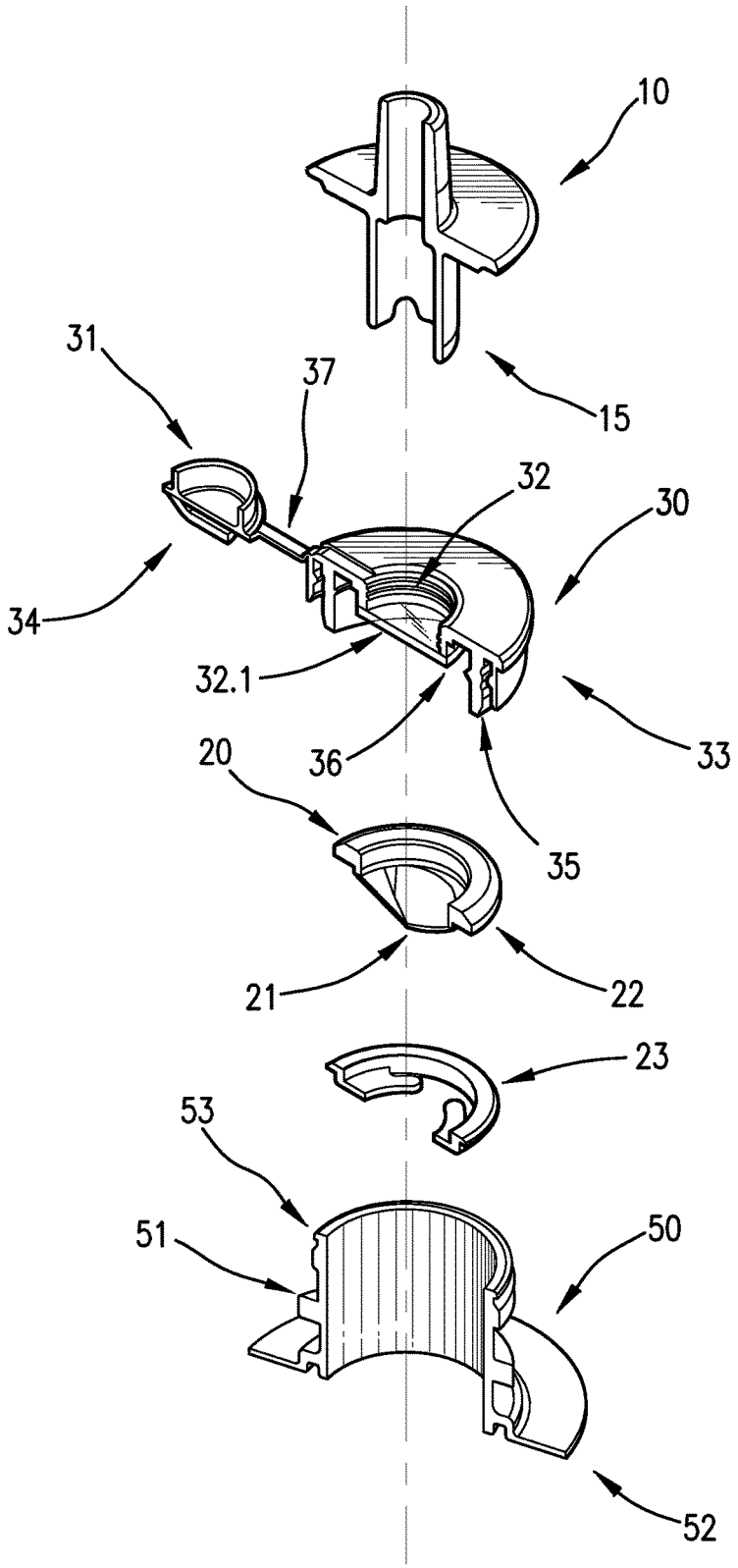
FIG. 4 is a cross sectional view of the assembly of the fitment taken at line A-A of FIG. 3.

FIG. 4, which is a cross sectional view of the assembly of the fitment (taken at line A-A' in FIG. 3) shows the positioning of the cap duckbill 20 in the aseptic flip-cap 30 and the aseptic flip-cap 30 onto the spout 50. The aseptic flip-cap 30 has two U-shaped collar openings: 35, which is the outer opening, and 36, which is the inner opening. The duckbill seal 22 of the cap duckbill 20 fits into the U-shaped collar opening 36 of the cap duckbill 20 and forms a seal. When the probe lead-in 15 of the probe 10 engages with the cap duckbill 20, the flow opening 21 of the cap duckbill 20 is forced open and fluid is allowed to flow. Similarly, when the probe 10 is disengaged, the flow opening 21 closes and seals and prevents further flow of any fluid from the bag. Duckbill lock ring 23 holds the flow opening 21 of the cap duckbill 20 closed until the probe 10 engages the cap duckbill 20 to allow flow of liquid and the top ring of the duckbill lock ring 23 fits into the inner opening 36 of the aseptic flip-cap 30 and forms a seal with the aseptic flip-cap 30.

As illustrated in the FIG. 4, the aseptic flip-cap 30 fits over the spout 50. The proximal end of the spout 50 fits into the outer U-shaped collar opening 35 of the aseptic flip-cap 30 and a seal is formed with the spout seal beads 53 of the spout 50.

Figure 5:
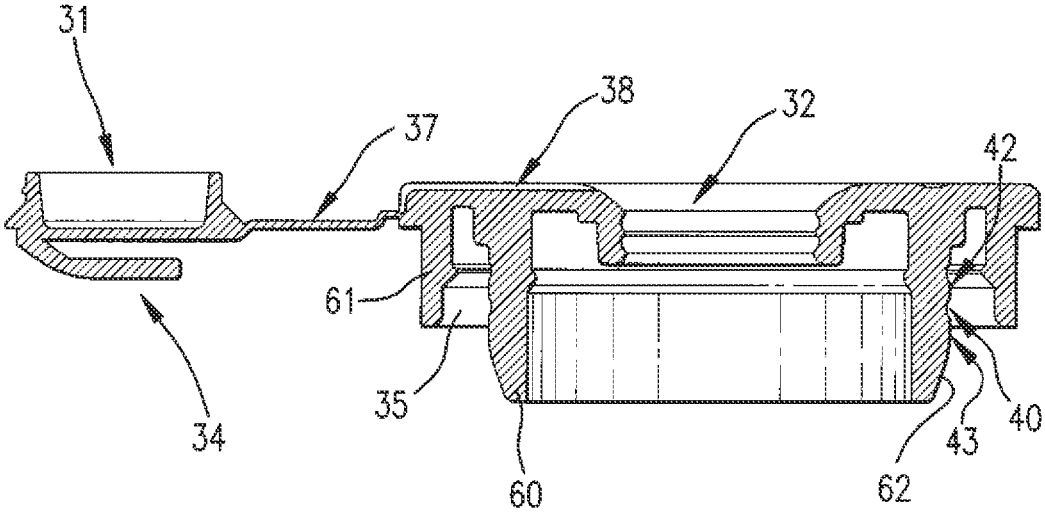
FIG. 5 is a cross sectional view of the aseptic flip-cap fitment.

FIG. 5 is a partial cross sectional view of the aseptic flip-cap 30.

Figure 6:
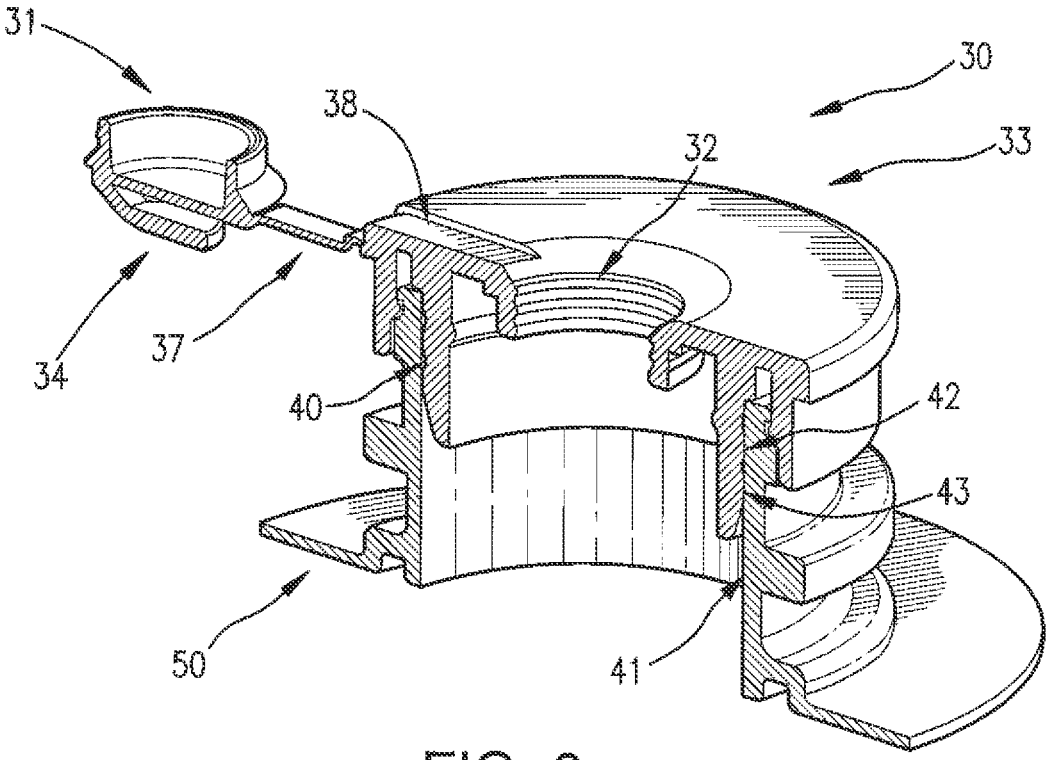
FIG. 6 is a perspective of the cross sectional view of the aseptic flip-cap fitment mounted on the spout.

FIG. 6 is a perspective of the cross-sectional view that shows the aseptic flip-cap 30 mounted on the spout 50. The aseptic flip-cap 30 is mounted on the spout 50 with the outer U-shaped collar opening 35 creating an aseptic seal with the inner wall 41 of the spout 50. The outer U-shaped collar opening 35 has an inner collar 60 and an outer flange 61. The inner collar 60, of outer U-shaped collar opening 35, comprises at least one sealing ring or sealing bead 42 on the inner collar 60's outside wall 62. The sealing ring 42 is a protrusion projecting outward from the outside wall 62 of the inner collar 60 of the outer U-shaped collar opening 35. Because it protrudes outwardly, the sealing ring 42 exerts sufficient force on the inner wall 41 of the spout 50 to create an aseptic seal.

Figure 7:
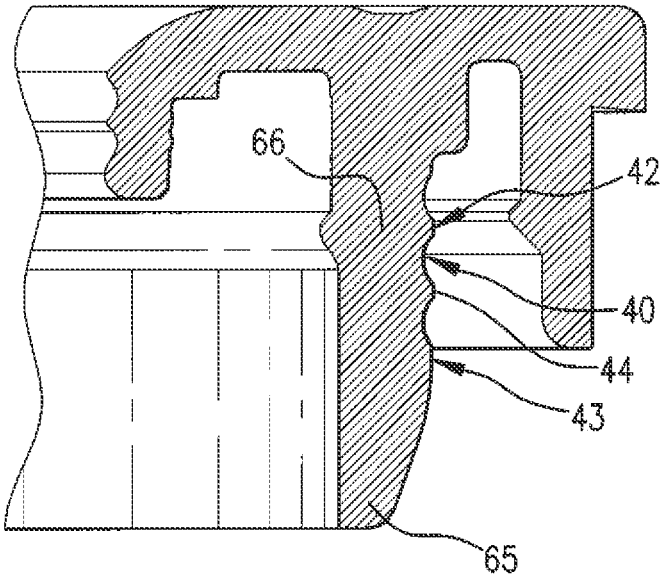
FIG. 7 is a magnified view of the sealing rings and inner collar in cross section view of the aseptic flip-cap fitment.

In an alternative embodiment, as shown in FIG. 7, more than one sealing rings 42, 43, and 44, are provided on the outside wall 62 of the inner collar 60. The surface of the protruding sealing rings 42-44 can be flat or curved. As shown in FIG. 7, the surface of the sealing ring 44 is flat while the surfaces of the sealing rings 42 and 43 are curved. The curvature of the protruding sealing rings can assume a flat-shape or a triangular shape with only a line contact with the inner wall 41 of the spout 50. The curvature of the protruding sealing rings can assume shapes that are intermediate between the flat shape and the triangular shape.

It should be noted that in alternative embodiments, the sealing ring 42 may not protrude outside of the outside wall 62 of the inner collar 60 of the outer U-shaped collar opening 35, and instead may be generally flush with said outside wall 62 of the inner collar 60 of the outer U-shaped collar opening 35. Stated another way, the sealing rings 42, 43, and 44 may be formed by the circular depression (trough) 40 shown in FIG. 6.

In still another alternative embodiment, the orientation of the inner collar 60 of the outer U-shaped collar opening 35 as compared to the spout 50 may not be vertical (the angle between the spout annular wall and the annular wall of the inner collar 60 of the outer U-shaped collar opening 35 is 180°) but instead, may vary between 155° and 205°. When the angle is greater than 180°, the proximal end of the inner collar 60 of the outer U-shaped collar opening 35 will be closer to the spout 50 than the distal end.

Figure 8:
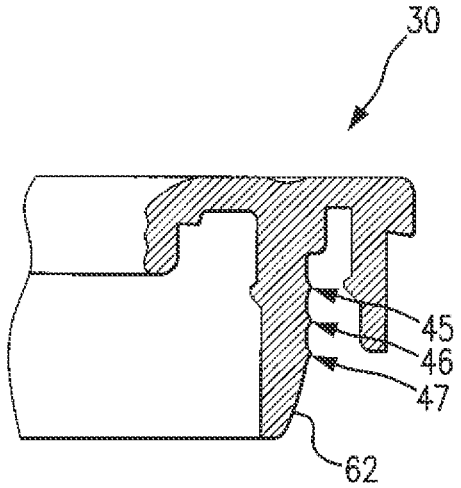
FIG. 8 is a magnified view of a cross section of the aseptic flip-cap showing sealing rings on the outside wall of the aseptic flip-cap.
Figure 9:
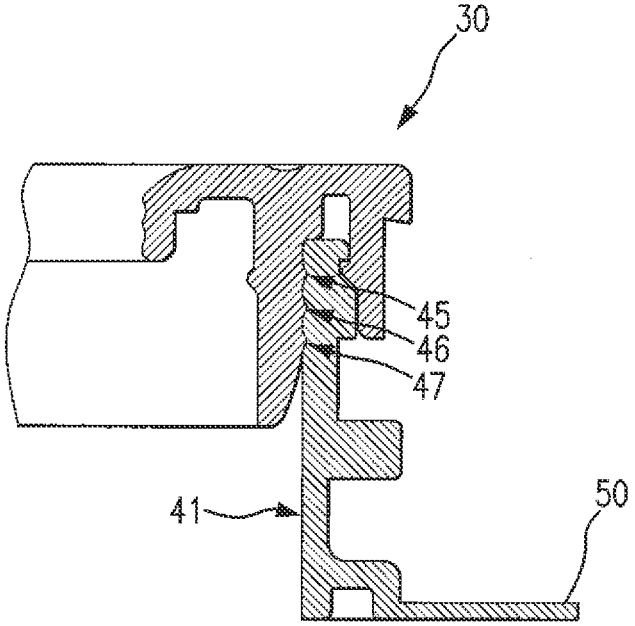
FIG. 9 is a magnified view of a cross section of the aseptic flip-cap having sealing rings mounted on the spout.

FIG. 8 shows a magnified view of a cross section of the aseptic flip-cap 30 showing three sealing rings 45, 46 and 47 on the outside wall 62 of the aseptic flip-cap. FIG. 9 shows the aseptic flip-cap 30 as shown in FIG. 8 positioned over spout 50 wherein the inner wall 41 of the spout 50 is flat and sealing rings 45, 46 and 47 form a seal with the inner wall 41 of the spout 50.

Figure 10:
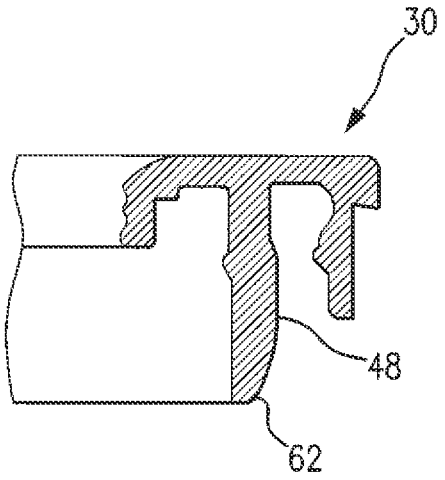
FIG. 10 is a magnified view of a cross section of the aseptic flip-cap not having sealing rings thereon.
Figure 11:
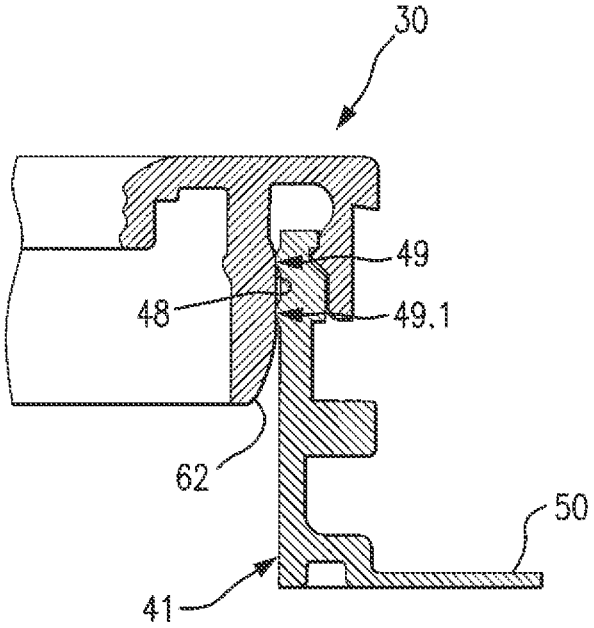
FIG. 11 is a magnified view of a cross section of the aseptic flip-cap not having sealing rings thereon mounted on a spout having sealing rings on the inner wall of the spout.

FIG. 10 shows a magnified view of a cross section of the aseptic flip-cap 30 that does not have sealing rings on the outside wall 62 but has a flat section 48 which engages with seals on the spout as shown in FIG. 11.

FIG. 11 shows a magnified view of a cross section of the aseptic flip-cap 30 that does not have sealing rings as shown in FIG. 10 wherein the flip-cap 30 is mounted on spout 50. The spout 50 has sealing rings 49 and 49.1 positioned on the inner wall 41 of the spout and these rings 49 and 49.1 form a seal with the flat section 48 of the outside wall 62 of the flip-cap 30.

In one embodiment, the aseptic seal comprises at least one seal ring. In another embodiment, the aseptic seal comprises 1, 2, 3, 4, or 5, seal rings. In an embodiment with more than one seal rings, at least two of the seal rings have different curvatures as described above. In another embodiment with more than one seal ring, all seal rings have the same curvature of their surface as described above.

Spout 50 is attached to a bag not shown via the molded sealing flange 52. Typically, the sealing flange 52 is heat sealed to the bag or container. The spout 50 has a handling flange 51 for ease of handling the fitment and the bag when attached. The spout 50 is molded from any of the aforementioned thermoplastic materials, although, polyethylene is preferred.

The aseptic flip-cap, in one embodiment is made from the same material as the spout. In another embodiment, the aseptic flip-cap is made from a material that has a higher hardness than that of the material of the spout. In yet another embodiment, the aseptic flip-cap is made from a material that has a lower hardness than that of the material of the spout. In another embodiment, the aseptic flip-cap is made from a material that has a higher toughness than that of the material of the spout. In yet another embodiment, the aseptic flip-cap is made from a material that has a lower toughness than that of the material of the spout.

The aseptic seal is advantageous in filling operation. In one embodiment, an unfilled a collapsible bag has a fitment assembly with the aseptic flip-cap mounted on the spout. The aseptic flip-cap ensures that the collapsible bag is completely sealed before the filling operation. In one embodiment, during the filling operation, the liquid to be filled into the collapsible bag is introduced into the collapsible bag under aseptic conditions. In one embodiment, the filler mechanism removes the aseptic flip-cap mounted on the spout on the unfilled collapsible bag, fills the collapsible bag and remounts or reattaches the aseptic flip-cap onto the spout. Thus the liquid now in the filled bag is under aseptic seal.

The invention as fully described above may embody other specific forms or variations without departing from its spirit or essential characteristics. In that regard, the embodiments described above are to be considered in all respects as illustrative and not restrictive, the scope of the invention being indicated by the claims rather than by the foregoing description and any and all changes which come within the meaning and range of equivalency of the claims are intended to be embraced therein.

What is claimed is:

1. A fitment for use on a collapsible bag for dispensing of liquids and semi-solids from the bag, the fitment consisting of:

(a) a spout consisting of a generally hollow cylindrical body having an external surface capable of mating with an aseptic flip-cap and an internal surface capable of forming an aseptic seal with an aseptic flip cap and the spout having at one end, a base portion for securing the spout to the collapsible bag;

(b) an aseptic flip-cap consisting of an outer collar and an inner collar with the outer collar and the inner collar each having an inner and outer surface, the inner surface of the outer collar and the outer surface of the inner collar forming a cavity adapted to be removably attachable to the spout, the inner surface of the inner collar being capable of attaching to a cap duckbill, and a hollow cylinder section having a proximal end and a distal end with each having an inner and outer surface, the cylinder section being fixedly attached at its distal end to the inner collar, the inner surface of the inner collar and the outer surface of the proximal end of the cylinder forming a cavity and a flange fixedly attached to the outer surface of the outer collar; and wherein the outer surface of said inner collar of the aseptic flip-cap consists of at least two sealing rings having different surfaces wherein the surfaces are selected from the group consisting of (A) curved surface, (B) triangular surface and (C) flat surface capable of forming an aseptic seal with the internal surface of the spout;

(c) a slidably removable probe; and (d) a substantially hollow cap duckbill adapted to mate with the proximal end of the aseptic flip-cap and which forms a seal within the fitment that can be unsealed by insertion of the probe into the fitment through the hollow cylinder of the aseptic flip-cap, the cap duckbill having a dome and a tapered end and an ejection end, the tapered end having a reversibly sealable slit capable of preventing fluid flow through the aseptic flip-cap upon removal of the probe from the fitment.

2. The fitment of claim 1, wherein the reversibly sealable slit of the cap duckbill is sealed closed and when punctured by the probe is opened and then reseals on removal of the probe.

3. The fitment as recited in claim 1, wherein said at least one sealing ring is flush with the surface of the outer wall of said inner collar.

4. The fitment as recited in claim 1, wherein the angular orientation between the spout annular wall and the annular wall of the inner collar is in the range of from about 155° to about 205°.

5. The fitment as recited in claim 1, wherein said aseptic flip-cap material is selected from the group consisting of (a) material that is the same material as the spout; (b) material that has a higher hardness than that of the material of the spout; (c) material that has a lower hardness than that of the material of the spout; (d) material that has a higher toughness than that of the material of the spout; and (e) material that has a lower toughness than that of the material of the spout.

6. The fitment of claim 1, wherein the probe consists of a generally hollow cylindrical body having a proximal end and a distal end, the distal end forming a nozzle having a nipple capable of mating with a tube, the proximal end having an external surface adapted to mate with the inner surface of the distal end of the aseptic flip-cap, the proximal end further having at least one indentation which permits fluid flow through the probe when the dome of the cap duckbill has been collapsed by the probe, the proximal end and distal end being separated by a flange on the outer surface of the probe which extends around the circumference of the probe, the probe when mated with the aseptic flip-cap, collapsing the dome of the cap duckbill thereby removing the seal between the aseptic flip-cap and the cap duckbill to allow fluid flow from the bag through the fitment, and the probe when removed from mating with the aseptic flip-cap uncollapsing the dome of cap duckbill thereby resealing the seal between the aseptic flip-cap and the cap duckbill.

7. The fitment of claim 6, consists of the cap duckbill having a tapered end and a receiving end, the tapered end having a reversibly sealable slit capable of preventing backflow of fluid upon removal of the tube from the probe, the receiving end being in fluid communication with the flow from the spout when the seal between the aseptic flip-cap and the cap duckbill has been removed.

8. The fitment of claim 1, wherein the aseptic flip-cap consists of a flip-top lid joined to the aseptic flip-cap by a hinge which allows the flip-top lid to move between a closed position on the aseptic flip-cap whereby the hollow cylinder section is covered and an open position away from the hollow cylinder.

9. The fitment of claim 8, wherein the hinge of the flip-top lid is recessed into the aseptic flip-cap and thereby allowing the flip-top lid to be recessed into the cavity in the aseptic flip-cap.

10. The fitment of claim 1, wherein the cap duckbill is attached to the inner surface of the collar of the aseptic flip-cap.

11. The fitment of claim 10, wherein the cap duckbill is attached by being welded or heat sealed to the collar of the aseptic flip-cap.

12. A process for filling an unfilled collapsible bag for dispensing of liquids and semi-solids from said collapsible bag, comprising a fitment as recited in claim 1, comprising:

(a) introducing said unfilled collapsible bag into a filling chamber under aseptic conditions;
(b) dismounting said fitment from said spout on said unfilled collapsible bag under aseptic conditions;
(c) filling said unfilled collapsible bag with material for dispensation;
(d) re-mounting said fitment on said spout; and
(e) closing the aseptic flip-cap.

13. A fitment for use on a collapsible bag for dispensing of liquids and semi-solids from the bag, the fitment consisting of:

(a) a spout consisting of a generally hollow cylindrical body having an external surface capable of mating with an aseptic flip-cap and an internal surface having at least one sealing ring capable of forming a seal with the aseptic flip-cap, the spout having at one end, a base portion for securing the spout to the collapsible bag;
(b) an aseptic flip-cap consisting of an outer collar and an inner collar with the outer collar and the inner collar each having an inner and outer surface, the inner surface of the outer collar and the outer surface of the inner collar forming a cavity adapted to be removably attachable to the spout, the inner surface of the inner collar being capable of attaching to a cap duckbill, a hollow cylinder section having a proximal end and a distal end with each having an inner and outer surface, the cylinder section being fixedly attached at its distal end to the inner collar, the inner surface of the inner collar and the outer surface of the proximal end of the cylinder forming a cavity and a flange fixedly attached to the outer surface of the outer collar; wherein the outer surface of said inner collar of the aseptic flip-cap forms a seal with the at least two different sealing rings of the spout having different surfaces selected from the group consisting of (A) curved surface, (B) triangular surface and (C) flat surface;
(c) a slidably removable probe; and
(d) a substantially hollow cap duckbill adapted to mate with the proximal end of the aseptic flip-cap and which forms a seal within the fitment that can be unsealed by insertion of the probe into the fitment through the hollow cylinder of the aseptic flip-cap, the cap duckbill having a dome and a tapered end and an ejection end, the tapered end having a reversibly sealable slit capable of preventing fluid flow through the aseptic flip-cap upon removal of the probe from the fitment.

* * * * *